United States Patent [19]

Kanazawa

[11] 4,391,040

[45] Jul. 5, 1983

[54] HAIR CUTTING DEVICE

[76] Inventor: Yukio Kanazawa, No. 880 Sekishi-cho, Hamamastu-shi, Shizuoka-ken, Japan

[21] Appl. No.: 309,817

[22] Filed: Oct. 8, 1981

[51] Int. Cl.[3] ..... B26B 19/20; B26B 19/44

[52] U.S. Cl. ..... 30/201; 30/133; 132/45 R

[58] Field of Search ..... 30/201, 202, 133; 132/45 R

[56] References Cited

U.S. PATENT DOCUMENTS

| | | | |
|---|---|---|---|
| 2,044,259 | 6/1936 | Roberts | 30/202 |
| 2,972,351 | 2/1961 | Morgan | 132/45 R |
| 3,209,455 | 10/1965 | Gnage | 30/201 |
| 3,302,286 | 2/1967 | Zucker | 30/133 |
| 3,979,825 | 9/1976 | Baumann | 30/201 X |
| 4,188,720 | 2/1980 | Korf | 30/133 |

FOREIGN PATENT DOCUMENTS

| | | | |
|---|---|---|---|
| 615777 | 7/1935 | Fed. Rep. of Germany | 30/202 |
| 1261285 | 4/1960 | France | 30/202 |

*Primary Examiner*—Jimmy C. Peters

*Attorney, Agent, or Firm*—Nathaniel A. Humphries

[57] ABSTRACT

A hair cutting unit device for the human head includes a movable open-ended casing in which an electrically operated clipper is mounted on guide means for movement. The blades of the clipper are in the open end of the casing. The position of the clipper with respect to the casing will fluctuate so that the cutting blades are moved away from the open end as the unit is moved upwardly on a head from the lower hairline so as to gradually increase the length of hair being left on the head. Rotary drums and threads in the casing are connected to a fixed member in which the head is positioned to effect translation of the clipper relative to the casing in response to movement of the unit upwardly from the lower hairline.

15 Claims, 22 Drawing Figures

HAIR CUTTING DEVICE

BACKGROUND OF THE INVENTION

This invention relates to hair cutting devices and more particularly to a hair cutting device wherein the bodily movement of the device adjacent the surface of a head to cut hair and the movement of the clipper blade portion of the device a controlled distance from the surface of the head are operatively effected in controlled relation with each other.

In a conventional hair cutting device, the distance between the device and the head is adjusted in accordance with the skill and judgment of the barber and considerable skill is consequently required for cutting hair. A hair cutting device wherein the distance between the head surface and cutting blade end surface can be automatically adjusted in accordance with the movement of the hair cutting device along the head surface has not previously been known.

The present inventor is the inventor of a "Hair Cutting Device" as shown in U.S. Pat. No. 4,150,483. The present invention represents a new improvement and advance over the aforementioned device.

An object of the present invention is to provide a hair cutting device in which the movement of the device and the distance of the cutting blade end surface from the head surface are jointly operatively connected and controlled.

The above-mentioned and other objects and advantages of the present invention will be made clear from the following description.

SUMMARY

The hair cutting device of the present invention comprises an electrically operated clipper and an open-ended hollow casing wherein the fixed cutting blade end surface of the clipper is arranged in the open end of the casing so that both end surfaces can be in the same plane, the clipper is moved relative to the open end in the casing by threads on rotary drums connected to an external object positioned adjacent the hair to be cut. A resilient member connects the casing with the clipper and returns the clipper to the original position. A power transmitting thread connects the above-mentioned rotary drum means with the clipper to operatively effect the displacement of the clipper in the casing so that the drums can be rotated to change the relative position of the clipper within the casing.

In the hair cutting device of the present invention, sliding members are provided on the side surface of the clipper, guide rails for the above-mentioned sliding members are provided on the casing and the resilient member connecting the clipper with the casing can be formed on a second rotary drum within the casing on the fixed cutting blade end surface of the clipper. A second thread is fixed at one end on the second drum and connected at the other end to a fitting member on the side surface of the clipper; a spring is supported at one end by the casing and a third thread is wound reversely to the second thread and fixed at one end on the second drum and connected at the other end to the spring.

The power transmitting means of the hair cutting device can also be formed of a rotary drum on which a thread connected to a connector is wound and which is pivoted within the casing at the end on the other side of the end on the fixed cutting blade side of the clipper and a thread wound reversely to the thread connected to the connector is fixed at one end on this drum and connected at the other end to a connector member on the side surface of the clipper in the form of a pulley provided on the side surface of the clipper. A thread wound on the pulley is fixed at one end to the casing and is wound reversely to the other thread on the rotary drum. Driving movement to the clipper can also be effected by a pinion provided integrally with the rotary drum on which the thread connected to the connector is wound and a rack engaged with the pinion and provided on the side surface of the clipper.

The device of the present invention can be also of a formation wherein a clipper in which the fixed cutting blade end surface is inclined to the casing and clipper axis. First and second rotary drums are coaxially pivoted within the casing to the fixed cutting blade side end of the clipper, a first thread connected to a fixer is wound and fixed at the end on the first drum, a second thread is connected to a fitting member on the side surface of the clipper and a third thread is connected to a spring supported at one end by the casing are wound respectively reversely to each other and fixed at the ends on the second drum; a fourth thread is wound reversely to the first thread as fixed at one end on the first drum and is wound reversely to the winding on the first drum as fixed on a third drum pivoted within the casing to the end on the other side of the fixed cutting blade side end of the clipper. A fifth thread connected to a fitting member on the side surface of the clipper is wound reversely to the winding of the fourth thread as fixed on the third drum and the clipper is provided with slide members and the casing can be provided with guide rails for the above-mentioned slide members so as to linearly slide and displace the clipper. Alternatively, the clipper can be pivoted at the end on the other side of the fixed cutting blade side end to the casing so as to be rocked and displaced.

The rotary drums included in the hair cutting device of the present invention can have the thread winding cylinders made properly different from one another in the diameter so that the distance of the displacement of the clipper with the movement of the device can be varied and further a member making the peripheral edge of the cutting blade of the clipper communicate with a vacuum source can be provided.

In order to fit the connector to the hair cutting device of the present invention, there is provided a fitting member wherein a forehead contacting member, a chin receiving member, and a guide member for the above-mentioned connector are fitted to a supporting member so as to be adjustable in position. The casing to which the connector is connected through an internally fitted rotary drum is fitted to an electrically operated clipper so that the clipper is displaced with respect to the casing with the variation of the relative positions of the casing and connector.

The hair cutting device of the present invention can be also of a structure wherein a graduation is attached to the side surface of the clipper or its sliding member, a base line is attached to the casing side surface and a fixer or a thread clamping piece connected to the fixer is provided on the side surface of the casing so that the cutting blade of the clipper can be fixed at a predetermined distance from the tool end surface of the casing.

DESCRIPTION OF THE PREFERRED EMBODIMENTS

Figure 1A:
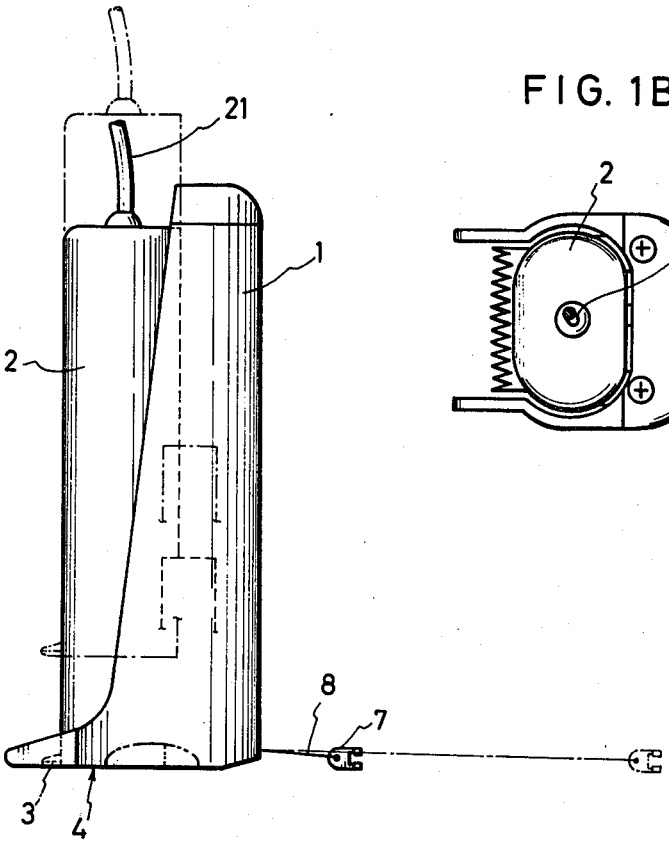
FIG. 1A is a side view of a first embodiment.
Figure 1B:
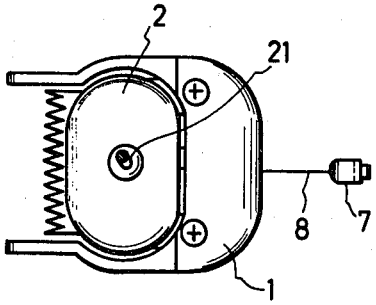
FIG. 1B is a plan view of FIG. 1A.
Figure 1C:
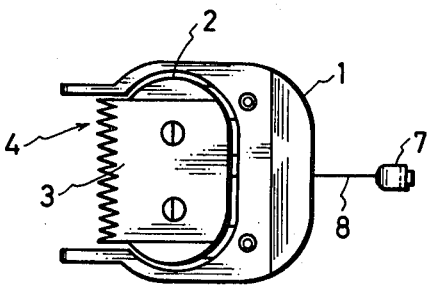
FIG. 1C is a bottom view of FIG. 1A.
Figure 2:
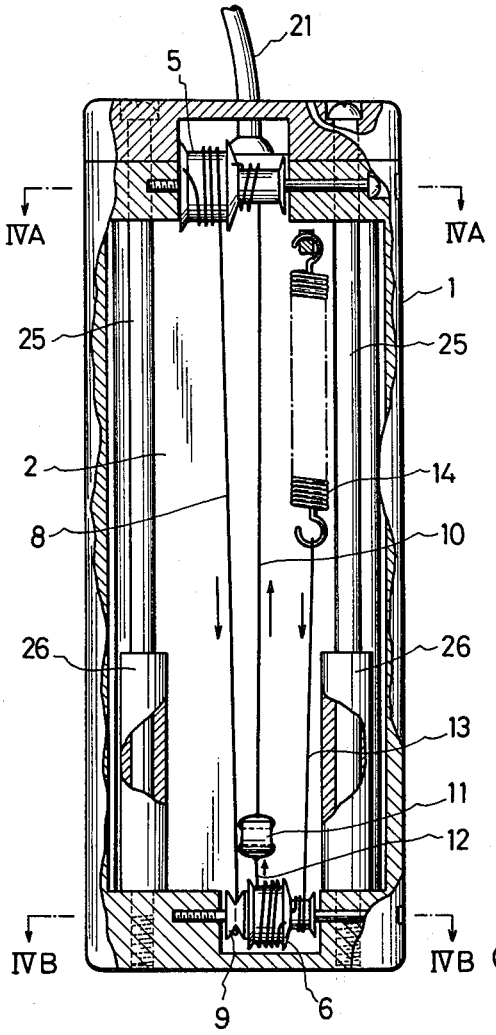
FIG. 2 is partly sectioned elevation of FIG. 1A.

The embodiments of the present invention shall be explained with reference to the drawings. In the embodiment shown in FIGS. 1 to 4, reference numeral 1 denotes a casing fitted to a clipper 2 so that the fixed cutting blade end surface 3 of the clipper 2 may coincide with the open end 4 at the end of the casing 1. First and second rotary drums 5 and 6 are provided adjacent the upper and lower ends of the casing 1. A first thread or cord 8 is connected by its free end to a connector 7 provided outside the casing and is wound and fixed at its opposite end on the first rotary drum 5. Thread 8 also extends over a guide pulley 9 attached to the rotary drum 6 on the cutting blade end of the clipper 2. Further, a second thread or cord 10 is wound reversely to the above-mentioned thread 8 is fixed to the rotary drum 5 and is fixed at the other end to a fitting 11 formed on the side surface of the clipper 2.

Also, a third thread or cord 12 is fixed at one end to the fitting member 11 and is wound on the rotary drum 6 and is fixed at one end to the rotary drum 6. A fourth thread 13 is fixed at one end to the second rotary drum 6 and is wound on the drum reversely to the above-mentioned thread 12 and is connected at an opposite end to a spring 14 supported by the casing 1.

Figure 3:
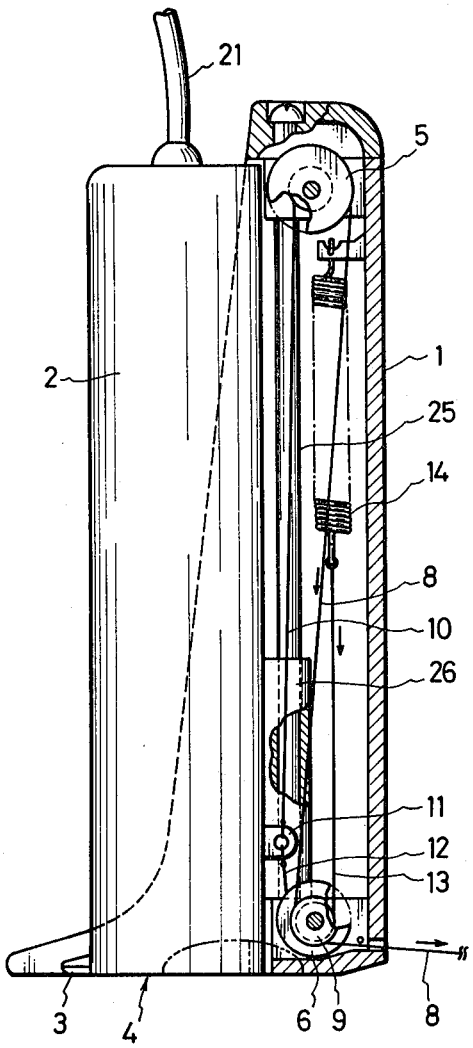
FIG. 3 is a partly sectioned view of FIG. 1A.
Figure 4A:
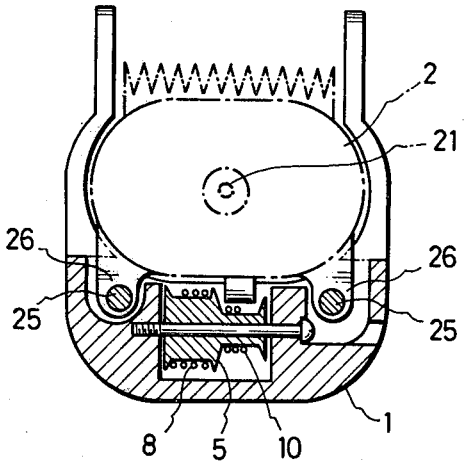
FIG. 4A is a sectioned view along line IVA—IVA in FIG. 2.
Figure 4B:
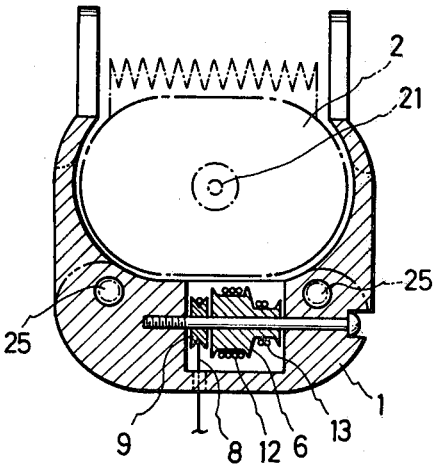
FIG. 4B is a sectioned view on line IVB—IVB in FIG. 2.
Figure 8:
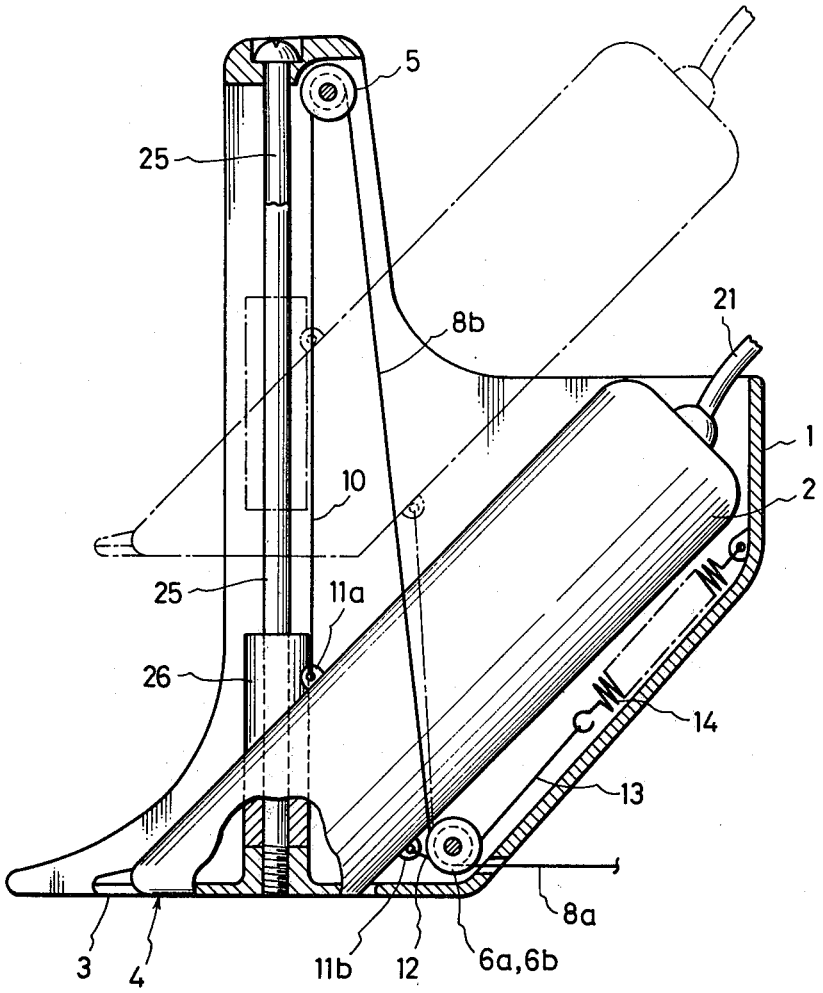
FIG. 8 is a partly sectioned view showing another embodiment.

Further, guide rails 25 to guide the movement of the clipper 2 are arranged within the casing 1 and slide members 26 attached to clipper 2 are mounted for sliding movement on the guide rails 25 so that the clipper 2 can move in a stable manner while operatively connected by thread means with the rotary drums. The clipper 2 is of a conventional electrically operated type receiving power via an electrical cord 21 and has its fixed cutting blade end surface 3 vertical to the axis of the clipper 2 as shown in FIG. 3. The fixed cutting blade end surface on the clipper may also be inclined to the axis of the clipper as shown in FIG. 8.

Figure 13:
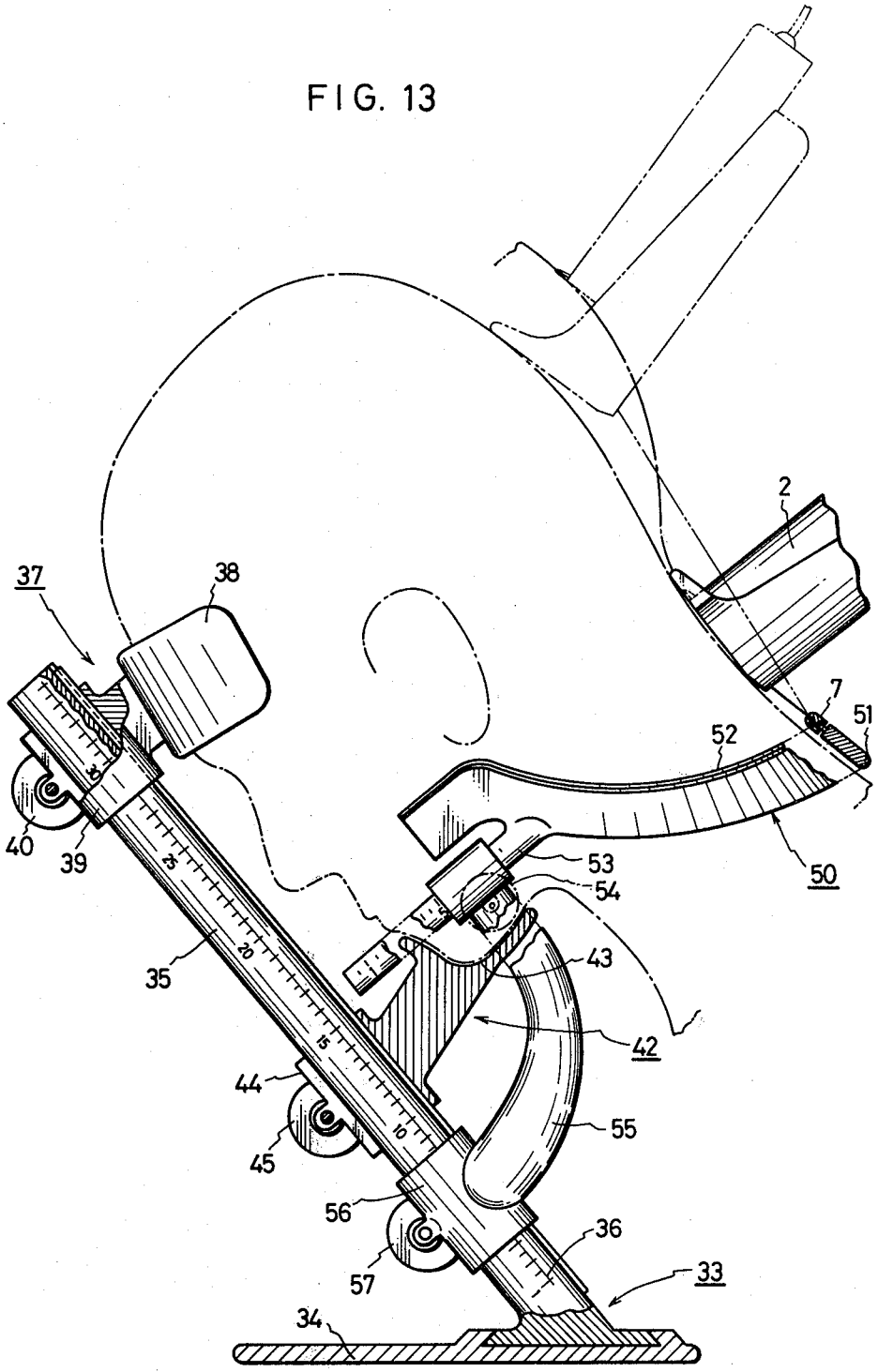
FIG. 13 is a side view of an embodiment of the hair cutting device fitting member of the present invention.
Figure 14A:
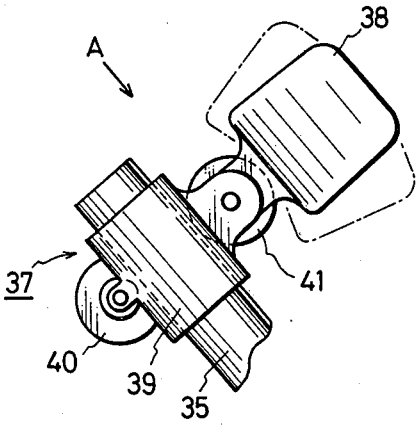
FIG. 14A is a side view of another mode of the forehead contacting member.
Figure 14B:
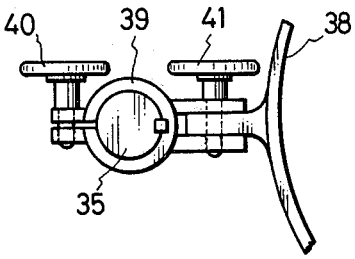
FIG. 14B is a view seen in the direction A of FIG. 14A.
Figure 15:
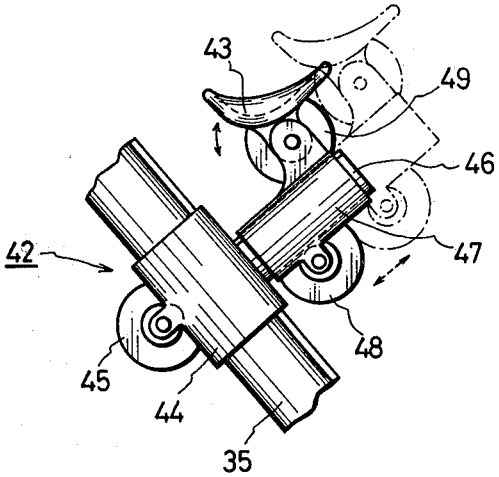
FIG. 15 is a side view of another mode of the chin receiving member.

The hair cutting device is used by fixing the connector in a position adjacent the lower edge of the hair on the neck of the person having his hair cut as shown in FIGS. 13 to 15 in which the fitting member comprises a supporting member 33, forehead contacting member 37, chin receiving member 42, and guide member 50. The supporting member 33 consists of a carrier rod 35 and base plate 34 which can be free-standing on a table or the like to the heavy weight of base plate 34. A scale 36 is attached to the side surface of the carrier rod 35 and the positions of the forehead contacting member 37, the chin receiving member 42 and guide member 50 will be able to be quickly adjusted in response to a desired position with respect to the head being cut.

The forehead contacting member 37 has a forehead restrainer 38 and an adjustable slide sleeve 39 and is fixed in a proper position by a clamp 40 or carrier rod 35. The forehead restrainer 38 is formed so as to be rotatable with respect to the slide rod 39 and the inclination of the forehead contacting surface can be made properly adjustable by fixing clamp knob 41 as shown in FIGS. 14A and 14B.

The chin receiving member 42 includes a chin support 43 carried on a slide tube 47 adjustably positioned on a carrier shaft 46 extending from a carrier sleeve 44 which is clamped in position on carrier rod 46 by clamp knob 45. Slide tube 47 is clamped in position on carrier rod 46 by clamp knob 48. The chin receiving support 43 is rotatable with respect to the fitting tube and can be held in adjusted rotary position by clamp knob 49. Thus, the chin receiving support 43 can be properly adjusted as shown in FIG. 15.

The guide member 50 consists of a guide frame 51 and a supporting part having an adjustable rod 53 held in adjusted position on the outer end of an arm 55 by a clamp knob 54. Arm 55 includes a slide sleeve 56 which can be clamped in desired position on carrier rod 35 by clamp knob 57. Connector 7 of the hair cutting device is connectable to a fitting part 52 on frame 51. The supporting rods 53 are inserted through the tips of two supporting arms 55 protruded out of the sleeve 56 and can be fixed in proper positions with clamp knobs 54.

Therefore, in the fitting apparatus of the present invention, the forehead contacting member 37, chin receiving member 42, and guide member 50 are fixed in properly adjusted positions, the inclinations of the contacting surface of the forehead restrainer 38 and chin receiving surface of the chin support 43 are adjusted as required for the particular human head whose hair is to be cut. The guide frame 51 is positioned and fixed on the lower edge of the hair on the rear part of the head, and the connector 7 of the hair cutting device is fitted to the guide member and the casing 1 and clipper 2 are moved along the surface of the head to permit the clipper to cut the hair.

When the clipper 2 is moved together with the casing 1, the thread 8 wound on the rotary drum 5 will be unwound, thereby the second thread 10 wound reversely on the rotary drum 5 will be wound onto the rotary drum 5, and the clipper 2 will gradually be moved and the fixed cutting blade end surface 3 will gradually move away from the open end surface 4 of the casing 1. Therefore, when the casing 1 is moved upwardly from the lower edge of the head, the clipper 2 will accordingly separate from the open end surface 4 of the casing 1 and will progressively move away from the head to leave the hair longer as it moves up the head as shown in FIG. 13.

By this movement of the clipper 2, the thread 12 fixed to the clipper 2 will be unwound from the rotary drum 6, at the same time, the thread 13 will be wound up on the rotary drum 6 and the spring 14 will be stretched. If the casing 1 is returned to the original position, the spring 14 will cause the clipper 2 to return to the original position in the casing 1 shown in FIG. 1A.

Thus, the connector 7 can then be shifted sideways on guide frame 51 to trim an adjacent area of the head along a cutting path adjacent the previous path of clipper travel over the head.

Figure 5:
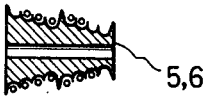
FIG. 5 is a sectioned view showing another embodiment.

FIG. 5 illustrates an alternative rotary drum 5, 6 having canted winding surfaces which can be used in place of drum 5 to give a different contour to the haircut provided by the apparatus.

Figure 6A:
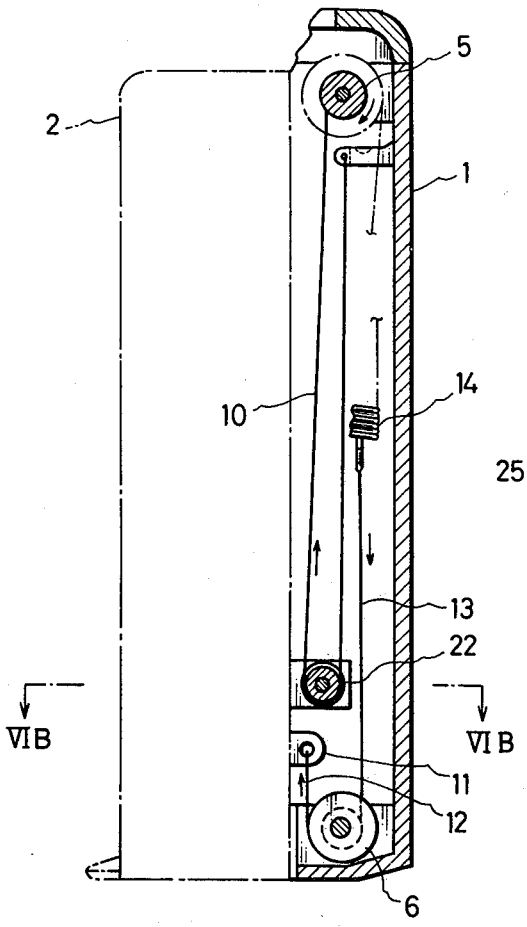
FIG. 6A is a partly sectioned side view showing another embodiment.
Figure 6B:
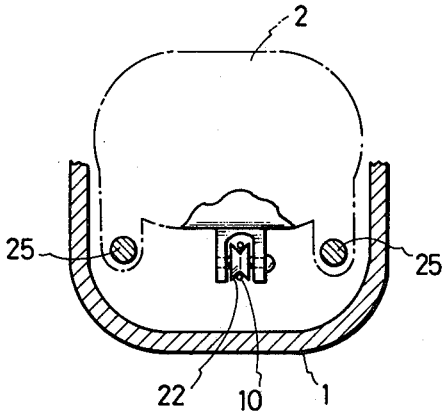
FIG. 6B is a sectioned view on line VIB—VIB in FIG. 6A.

In the embodiment shown in FIG. 6A and 6B, the thread 10 is wound on the rotary drum 5 and is fixed at the end to the inner wall of the casing 1 through a pulley 22 provided on the side surface of the clipper 2 so that the rotation of the drum will operatively effect the displacement of the clipper relative to casing 1. In such case, the moving distance of the clipper 2 with the movement of the casing will be smaller than it is when the thread 10 is fixed to the fitting member 11 of the clipper 2 as in the embodiment of FIGS. 1A, etc.

Figure 7A:
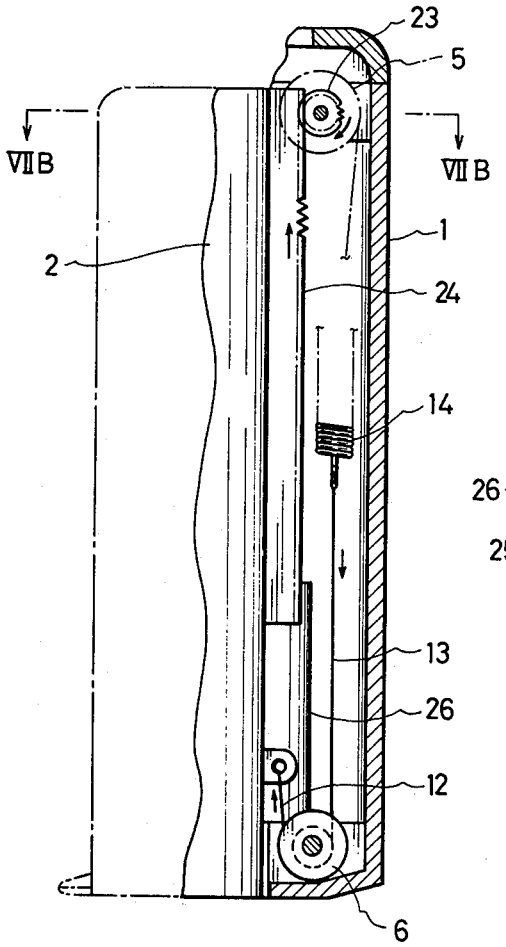
FIG. 7A is a partly sectioned side view showing another embodiment.
Figure 7B:
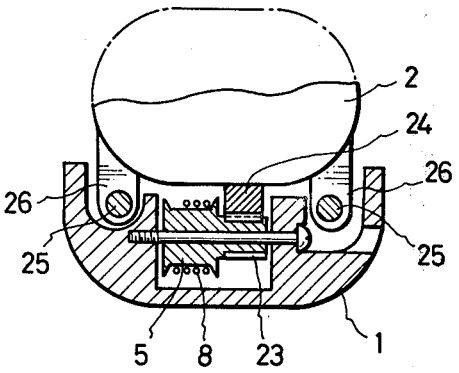
FIG. 7B is a sectioned view on line VII—VII in FIG. 7A.

In the embodiment shown of FIG. 7A and 7B, instead of the motion transmission being effected by using the thread 10, a pinion 23 is attached to the rotary drum 5 and a rack 24 is provided on the side surface of the clipper 2 so as to mesh with the pinion so that rotation of the pinion shifts the clipper longitudinally.

Figure 9A:
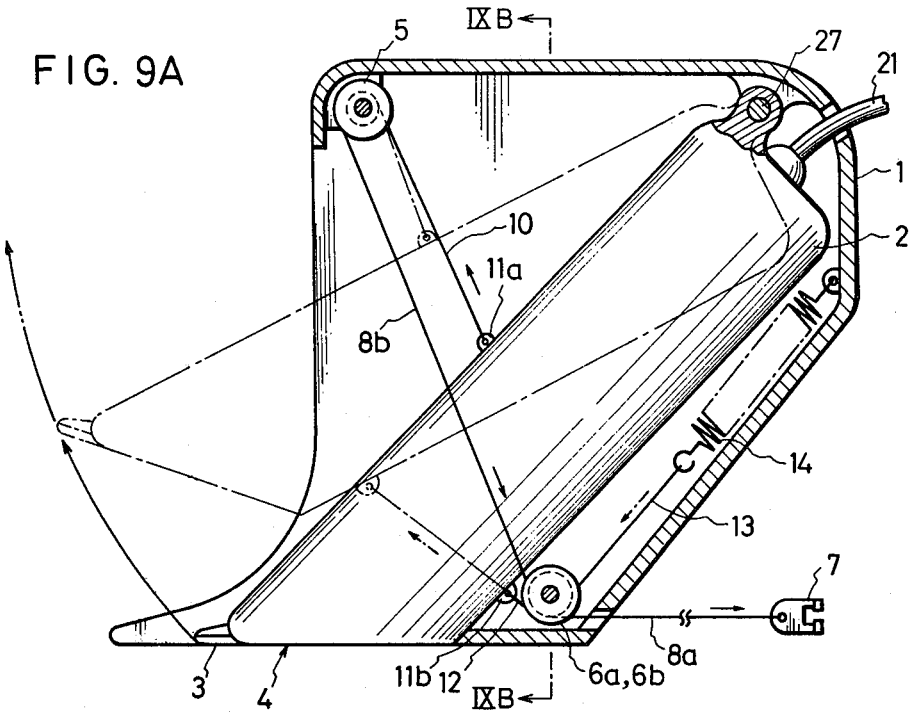
FIG. 9A is a partly sectioned view showing another embodiment.
Figure 9B:
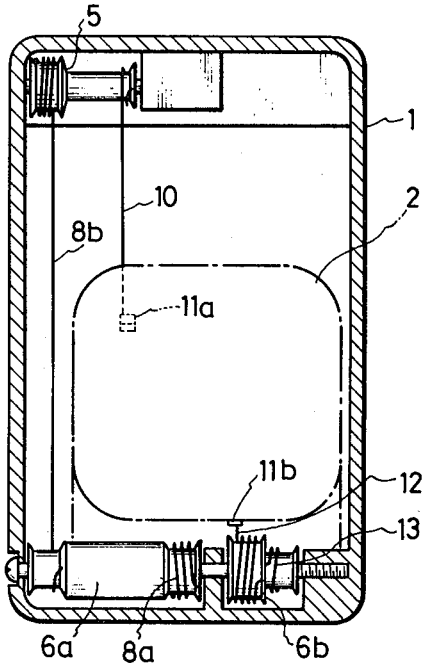
FIG. 9B is a sectioned view on line IX—IX in FIG. 9A.

Rotary drums 6*a* and 6*b* of the embodiment of FIGS. 9A and 9B are rotated, and a thread 8*a* is connected to the connector 7 and is wound and fixed at the end on the drum 6*a*. A thread 12 is connected to a fitting member 11*b* on the clipper and a thread 13 is connected to a spring 14 supported at one end by the casing 1. Threads 12 and 13 are wound reversely to each other so that when the thread 12 is unwound, the thread 13 will be wound. A thread 8*b* is attached to one end of the rotary drum 6 and is wound reversely to the thread 8*a* so that when thread 8*a* is wound, 8*b* will be unwound. A thread 10 is mounted on drum 5 and connected to a fitting member 11*a* on the side surface of the clipper and is wound on drum 5 reversely to the winding of the thread 8*b*. The clipper 2 is pivoted at one end opposite the fixed cutting blade end surface to the casing 1 by a pin 27 so that the clipper may be pivoted about the pin 27 as a fulcrum and the fixed cutting blade end surface 3 of the clipper 2 may be separated along an arcuate path from the opening surface 4 of the casing 1.

In the embodiment in FIG. 8, sliding members 26 are provided on the side surface of the clipper 2 and guide rails 25 for the above-mentioned sliding members 26 are respectively provided at right angles with the open end surface 4 in the casing so that the clipper 2 can move vertically.

By properly varying the diameters of the respective rotary drums of the hair cutting device of the present invention, the moving speed of the clipper 2 can be varied and the curve of the finished surface of cut hair can be varied. For example, as in the embodiment shown in FIGS. 2 and 4, steps are formed on the rotary drums 5 and 6 so that the respective threads can be wound on the drum surfaces of the respective steps. Further, as in the embodiment shown in FIG. 5, tapered steps may be formed on the rotary drum.

Figure 10:
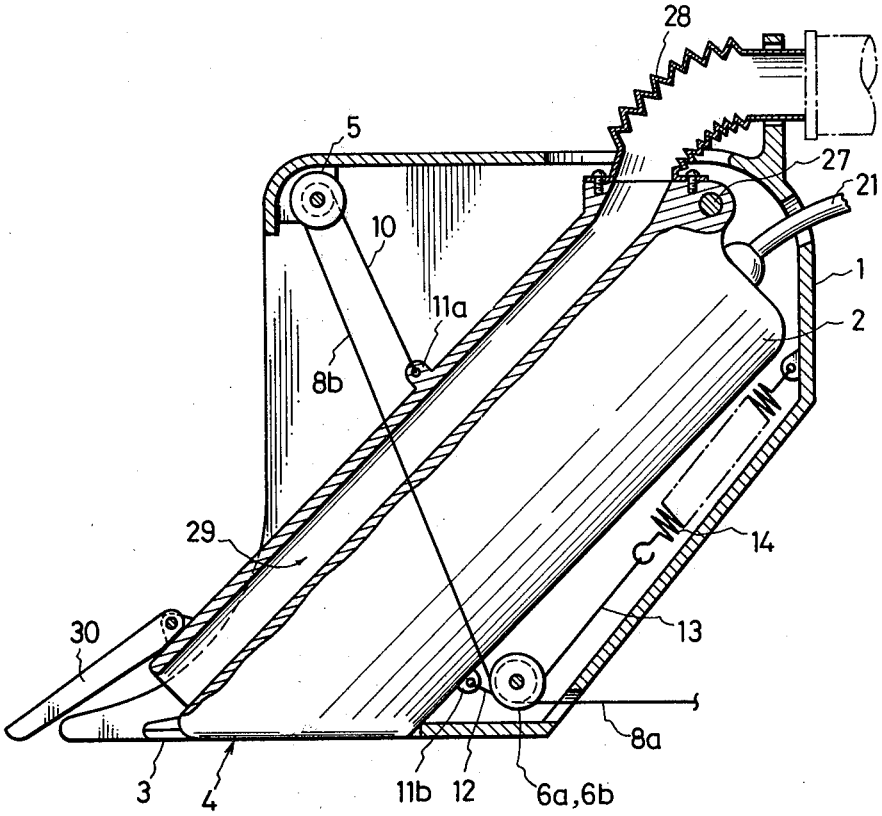
FIG. 10 is a partly sectioned view showing another embodiment.

In the embodiment shown in FIG. 10, a flow path 29 is connected to a vacuum source (not illustrated) through a flexible tube 28 and has an end near the cutting blade of the clipper 2 so that hairs will be sucked in through the flow path 29 and will be prevented from being scattered over the surrounding area. It should be understood that such a vacuum flow path 29 can be provided not only in the embodiment shown in FIG. 10 but also in any other embodiment.

In the hair cutting device of the present invention, a comb 30 can be provided outside near the cutting blade of the clipper so that hair can be cut while being raised by the comb 30 and the finished surface can be made better. Additionally, the comb 30 can be provided so as to be adjustable vertically and removable.

Figure 11:
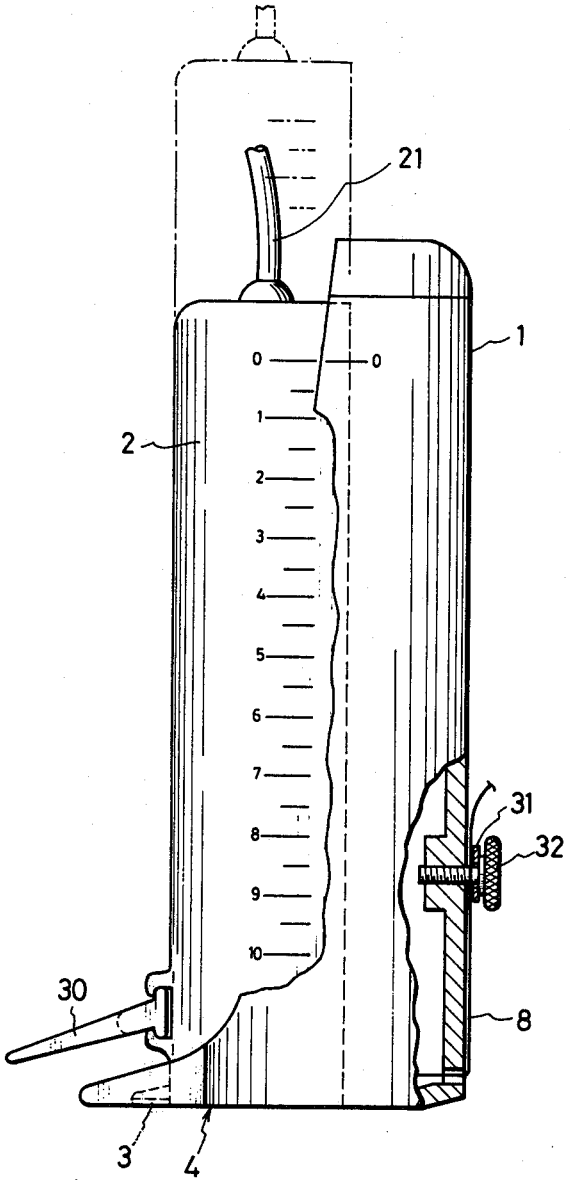
FIG. 11 is a partly sectioned view showing still another embodiment.
Figure 12:
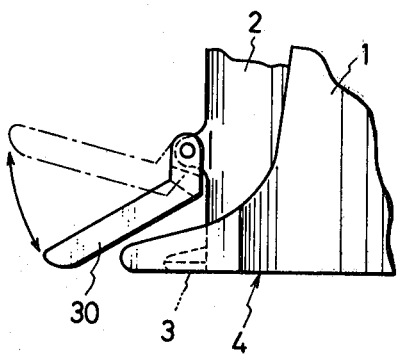
FIG. 12 is a side view of a tip of an embodiment.

Further, as shown in the embodiment of FIG. 11, a graduation can be made on the side surface of the clipper 2 adjacent a base line mark made on the casing 1. A set screw 32 or any other clamping member having a washer 31 can clamp thread 8 connected to connector 7 so that the thread 8 is fixed to the casing and the distance between the opening surface 4 of the casing the fixed cutting blade end surface 3 of the clipper 2 is set so that the casing 1 and clipper 2 will keep their relative positions and so-called 5% cut, 30% cut, or 50% cut can be made without using any auxiliary device.

As described above, according to the present invention, without requiring any skill, any desired hair cut can be easily made at any convenient location such as at home.

Further, since the fitting member of the present invention can be fixed in a predetermined position of the head without applying any load to the human body, the hair can be smoothly cut.

It should be understood that the spirit and scope of the present invention is not to be limited by the disclosed embodiments but is to be limited solely by the appended claims.

I claim:

1. A hair cutting device comprising a unit consisting of a casing having an open end surface and an electrically operated clipper having fixed cutting blade end surface arranged adjacent the open end surface of the casing when in a home position so that both end surfaces may be in the same plane, guide means supporting the clipper for guided controlled movement in the casing, a first rotary drum mounted in the casing, a first thread mounted on the first drum and having one end connected to a connector fixable to a fixedly positioned external object, power transmitting means connecting the rotary drum with the clipper to operatively effect displacement of the clipper from the home position relative to the casing in response to rotation of the rotary drum so that rotation of the rotary drum causes the relative position of the clipper with respect to the casing to vary in response to the spacing of the unit from the fixedly positioned external object, and resilient means connecting the casing with the clipper for urging the clipper toward said home position.

2. A hair cutting device according to claim 1 wherein said guide means includes slide members provided on the side surface of the clipper, guide rails provided on the casing and on which said slide members are mounted for movement and wherein the power rotary drum mounted for rotation within the casing on the open end side thereof, a second thread wound on and fixed at one end to the second rotary drum and connected at the other end to a side surface of the clipper, a spring supported at one end by the casing and a further thread wound reversely to the second thread and fixed at one end on the second drum and connected at the other end to said spring.

3. A hair cutting device according to claim 1 wherein the first rotary drum is positioned within the casing at the end opposite the fixed cutting blade side of the clipper and further including a second thread wound reversely to the first thread fixed at one end on the first drum and is connected at the other end to a fitting member protruding from a side of the clipper.

4. A hair cutting device according to claim 1 wherein the power transmitting means includes a pulley mounted on a side surface of the clipper and a second thread wound on the pulley with one end of the second thread being fixed to the casing and wound at an opposite end reversely to the first thread on the first rotary drum.

5. A hair cutting device according to claim 1 wherein the power transmitting means includes a pinion provided integrally with the first rotary drum and a rack meshing with the pinion mounted side surface of the clipper.

6. A hair cutting device according to either of claims 1 or 2 wherein the fixed cutting blade end surface of the clipper is at a right angle with respect to the axis of the clipper.

7. A hair cutting device according to claim 1 wherein said power transmitting means additionally includes a second drum positioned for rotation on the casing and coaxial with respect to the first drum and a third drum positioned on the casing on the opposite side of the clipper from the first drum, a second thread wound on the second drum and having one end connected to a first fitting on the clipper, a third thread wound on the third drum and having one end connected to a second fitting on the clipper and fourth thread wound on the third drum reversely to the third thread and having an opposite end connected to said first drum and wherein said resilient means includes a coil spring connected to the casing and to a fifth thread wound on said second drum.

8. A hair cutting device according to claim 7 wherein the clipper is provided with slide members on opposite sides and the casing is provided with guide rails on which the slide members are mounted for sliding movement.

9. A hair cutting device according to claim 7 wherein the clipper is pivoted at one end of the fixed cutting blade end within the casing so as to be pivotable relative to the casing.

10. A hair cutting device according to claim 7 wherein the diameters of the rotary drums are not uniform.

11. A hair cutting device according to claim 10 wherein at least some of the rotary drums have outer surfaces in the form of tapered steps.

12. A hair cutting device according to either of claims 1, 2, or 7 additionally including vacuum means communicating with an area adjacent the cutter blade of the clipper for removing hair clipping therefrom.

13. A hair cutting device according to either of claims 1, 2, or 7 additionally including a comb removably provided on the upper side of the cutting blade of the clipper.

14. A hair cutting device according to either of claims 1 or 7 wherein a graduation is attached to the side surface of the clipper, a base line is attached to the side surface of the casing and a clamping means is provided adjacent the first thread for clamping same in a desired position to achieve a desired hair cutting base level.

15. A hair cutting device according to claim 1 wherein said external object to which the connector attached to one end of the first thread comprises head engaging means including a forehead comtacting member, a chin receiving member adjustably mounted on a supporting member so as to be adjustable into a desired position.

* * * * *